US011408335B2

(12) United States Patent
Selway

(10) Patent No.: US 11,408,335 B2
(45) Date of Patent: Aug. 9, 2022

(54) MARINE ENGINE ASSEMBLY

(71) Applicant: COX POWERTRAIN LIMITED, Shoreham-by-Sea (GB)

(72) Inventor: Martin Selway, Shoreham-by-Sea (GB)

(73) Assignee: COX POWERTRAIN LIMITED, Shoreham-by-Sea (GB)

( * ) Notice: Subject to any disclaimer, the term of this patent is extended or adjusted under 35 U.S.C. 154(b) by 0 days.

(21) Appl. No.: 16/572,072

(22) Filed: Sep. 16, 2019

(65) Prior Publication Data

US 2020/0095925 A1 Mar. 26, 2020

(30) Foreign Application Priority Data

Sep. 20, 2018 (GB) ..... 1815311

(51) Int. Cl.

| | |
|---|---|
| ***F02B 61/04*** | (2006.01) |
| ***B63H 20/24*** | (2006.01) |
| ***F01N 3/04*** | (2006.01) |
| ***F01N 13/00*** | (2010.01) |
| ***F01N 13/16*** | (2010.01) |
| ***F01N 13/18*** | (2010.01) |
| ***F02B 37/00*** | (2006.01) |

(52) U.S. Cl.

CPC ..... *F02B 61/045* (2013.01); *B63H 20/24* (2013.01); *F01N 3/043* (2013.01); *F01N 13/004* (2013.01); *F01N 13/16* (2013.01); *F01N 13/1811* (2013.01); *F02B 37/00* (2013.01)

(58) Field of Classification Search

CPC ..... F02B 61/045; F02B 37/00; F02B 67/10; B63H 20/24; B63H 20/02; F01N 3/043; F01N 13/004; F01N 13/16; F01N 13/1811; F01N 2340/00

See application file for complete search history.

(56) References Cited

U.S. PATENT DOCUMENTS

| | | | | |
|---|---|---|---|---|
| 4,630,446 | A | 12/1986 | Iwai et al. | |
| 6,776,674 | B2 * | 8/2004 | Blanchard | B63H 11/08 248/640 |
| 9,080,535 | B2 | 7/2015 | Wittwer | |
| 2010/0223911 | A1 * | 9/2010 | Gockel | F01N 13/1811 60/280 |

(Continued)

FOREIGN PATENT DOCUMENTS

| | | |
|---|---|---|
| DE | 10344868 | 4/2005 |
| FR | 2918710 | 1/2009 |
| JP | S63-141897 | 6/1988 |

OTHER PUBLICATIONS

Search & Examination Report issued in Appl. No. GB1815311.4 (2018).

(Continued)

*Primary Examiner* — Loren C Edwards

(74) *Attorney, Agent, or Firm* — Barnes & Thornburg LLP

(57) ABSTRACT

A marine engine assembly is provided for propelling a marine vessel. The marine engine assembly includes an internal combustion engine configured to drive a propulsion arrangement, a turbocharger comprising a turbine portion having a turbine outlet, and a turbocharger exhaust conduit coupled to the turbine outlet. The turbocharger exhaust conduit acts as a primary support to the turbocharger within the marine engine assembly.

18 Claims, 6 Drawing Sheets

(56) References Cited

U.S. PATENT DOCUMENTS

| | | | | |
|---|---|---|---|---|
| 2011/0016859 | A1* | 1/2011 | Schumnig | F01N 13/10 60/323 |
| 2014/0041385 | A1* | 2/2014 | Wittwer | F01N 11/007 60/605.2 |

OTHER PUBLICATIONS

Search Report & Written Opinion issued in Int'l App. No. PCT/GB2019/052587 (2019).

* cited by examiner

MARINE ENGINE ASSEMBLY

CROSS REFERENCE TO RELATED APPLICATIONS

This application claims priority to United Kingdom patent application no. 1815311.4, filed Sep. 20, 2018. The disclosure set forth in the referenced application is incorporated herein by reference in its entirety.

FIELD OF THE INVENTION

The present invention relates to a marine engine assembly. In particular, the invention relates to a marine engine assembly having novel means for mounting a turbocharger thereto.

BACKGROUND OF THE INVENTION

In order to propel a marine vessel, a marine engine assembly is often attached to the stern of the vessel. The engine assembly includes an internal combustion engine, a propulsion arrangement and an exhaust system. For marine engine assemblies, a diesel internal combustion engine may be used having one or more turbochargers.

Traditionally, the weight of each turbocharger is supported, at least in the most part, by the exhaust manifold to which the turbocharger is mounted. As such, a turbocharger in a marine outboard typically has most of its weight, and any acceleration forces due to movement or vibration, reacted primarily through the exhaust manifold to which it is connected. In such arrangements, it can be difficult to meet the tight packaging requirements in marine settings, in particular those of marine outboard motor assemblies. Further, thermal management in marine engine assemblies can also present challenges.

The present invention seeks to overcome or at least mitigate one or more problems associated with the prior art.

SUMMARY OF THE INVENTION

A first aspect of the invention provides a marine engine assembly for propelling a marine vessel, the engine assembly comprising: an internal combustion engine configured to drive a propulsion arrangement; a turbocharger comprising a turbine portion having a turbine outlet; and a turbocharger exhaust conduit coupled to the turbine outlet; wherein the turbocharger exhaust conduit and acts as a primary support to the turbocharger within the marine engine assembly.

The turbocharger exhaust conduit may have a greater rigidity than any other connection of the turbocharger to the marine engine assembly.

The turbocharger exhaust conduit may be configured to rigidly mount the turbocharger to the support structure.

More of the mechanical forces from the turbocharger may be reacted through the turbocharger exhaust conduit than any other connection of the turbocharger to the engine assembly.

Substantially all of the mechanical forces from the turbocharger may be reacted through the turbocharger exhaust conduit.

The turbocharger exhaust conduit may be formed from a rigid material, e.g. from a metallic material.

The marine engine assembly may further comprise a support structure. The turbocharger may be connected to the support structure.

The marine engine assembly may comprise an exhaust system having an exhaust system inlet. The turbocharger exhaust conduit may be coupled to the exhaust system inlet.

The exhaust system may provide the function of the support structure.

The turbocharger exhaust conduit may be mounted to the support structure via an adaptor member.

The marine engine assembly may further comprise an exhaust manifold configured to deliver exhaust gas from the internal combustion engine to the turbocharger.

The turbocharger may be connected to the exhaust manifold via a flexible connecting arrangement.

The turbocharger may be mounted to the exhaust manifold via one or more thermal expansion joints.

The turbocharger may comprise a turbine portion having a turbine inlet and a turbine outlet. The turbocharger may comprise a compressor portion having a compressor inlet and a compressor outlet.

The exhaust manifold may be configured to deliver exhaust gas from the internal combustion engine to the turbine inlet.

The turbocharger exhaust conduit may define an exhaust flow path having an exhaust conduit inlet and an exhaust conduit outlet. The exhaust conduit inlet may be coupled to the turbine outlet.

The turbocharger may be further connected to the internal combustion engine via a flexible hose configured to deliver compressed air from the turbocharger to the internal combustion engine.

The turbocharger exhaust conduit may comprise a cooling arrangement for cooling the turbocharger exhaust conduit.

The turbocharger exhaust conduit may comprise a coolant flow path therethrough for cooling the turbocharger exhaust conduit.

The coolant flow path may be arranged to flow around the exhaust flow path.

The coolant flow path may be arranged to substantially surround the exhaust flow path.

The marine engine assembly may further comprise a propulsion arrangement arranged to be positioned below the internal combustion engine, in use.

The marine engine assembly may further comprise a crankshaft coupled to the internal combustion engine and configured to drive the propulsion arrangement.

The crankshaft may be intended to be substantially vertical, in use.

The internal combustion engine may be a diesel engine.

The exhaust conduit outlet may be positioned to be substantially level with or below a lower extent of the internal combustion engine, in use.

The turbocharger exhaust conduit may comprise a support strut for increasing the rigidity of the exhaust conduit.

According to a second aspect of the invention, there is provided a marine vessel comprising the marine engine assembly according to the first aspect.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
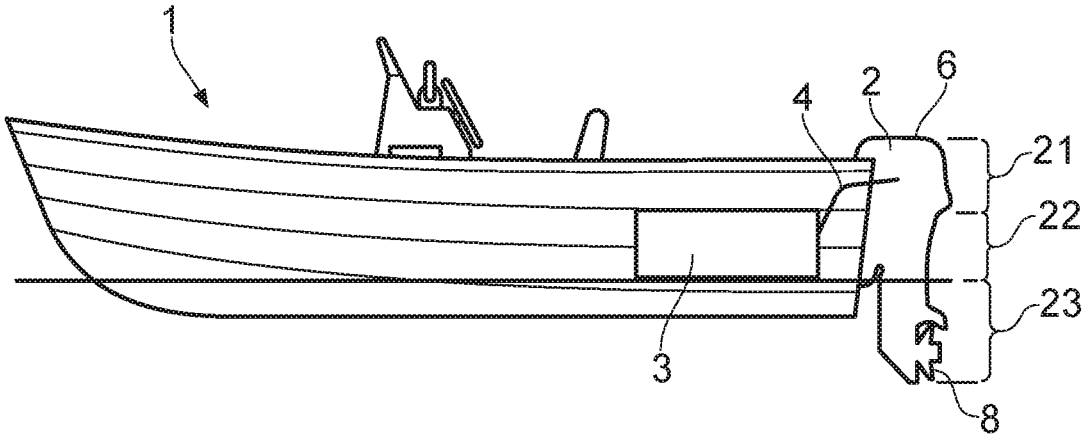
FIG. 1 is a schematic side view of a light marine vessel provided with a marine engine assembly.

Referring firstly to FIG. 1, there is shown a schematic side view of a marine vessel 1 with a marine engine assembly 2, in the form of an outboard motor assembly. The marine vessel 1 may be any kind of vessel suitable for use with a marine engine assembly, such as a tender or a scuba-diving boat. The marine engine assembly 2 shown in FIG. 1 is attached to the stern of the vessel 1. The marine engine assembly 2 is connected to a fuel tank 3, usually received within the hull of the marine vessel 1. Fuel from the reservoir or tank 3 is provided to the marine engine assembly 2 via a fuel line 4. Fuel line 4 may be a representation for a collective arrangement of one or more filters, low pressure pumps and separator tanks (for preventing water from entering the marine engine assembly 2) arranged between the fuel tank 3 and the marine engine assembly 2.

As will be described in more detail below, the marine engine assembly 2 is generally divided into three sections, an upper-section 21, a mid-section 22, and a lower-section 23. The three sections 21, 22 and 23 are collectively surrounded by a protective cowling 6. The mid-section 22 and lower-section 23 are often collectively known as the leg section, and the leg houses the exhaust system. The mid-section 22 connects the upper-section 21 to the lower-section 23 and houses a drive shaft 41 connected to a crankshaft of the internal combustion engine 30. A propeller 8 is rotatably arranged on a propeller shaft 9 at the lower-section 23, also known as the gearbox, of the marine engine assembly 2. Of course, in operation, the propeller 8 is at least partly submerged in water and may be operated at varying rotational speeds to propel the marine vessel 1. The propulsion arrangement, in the form of the propeller 8, is arranged to be positioned below the internal combustion engine, in use.

Typically, the marine engine assembly 2 is pivotally connected to the stern of the marine vessel 1 by means of a pivot pin. Pivotal movement about the pivot pin enables the operator to tilt and trim the marine engine assembly 2 about a horizontal axis in a manner known in the art. Further, as is well known in the art, the marine engine assembly 2 is also pivotally mounted to the stern of the marine vessel 1 so as to be able to pivot about a generally upright axis, to steer the marine vessel 1.

Tilting is a movement that raises the marine engine assembly 2 far enough so that the entire marine engine assembly 2 is able to be raised completely out of the water. Tilting the marine engine assembly 2 may be performed with the marine engine assembly 2 turned off or in neutral. However, in some instances, the marine engine assembly 2 may be configured to allow limited running of the marine engine assembly 2 in the tilt range so as to enable operation in shallow waters. Marine engine assemblies are therefore predominantly operated with a longitudinal axis of the leg in a substantially vertical direction. As such, a crankshaft of an engine of the marine engine assembly 2 which is substantially parallel to a longitudinal axis of the leg of the marine engine assembly 2 will be generally oriented in a vertical orientation during normal operation of the marine engine assembly 2, but may also be oriented in a non-vertical direction under certain operating conditions, in particular when operated on a vessel in shallow water. A crankshaft of a marine engine assembly 2 which is oriented substantially parallel to a longitudinal axis of the leg of the engine assembly can also be termed a vertical crankshaft arrangement. A crankshaft of a marine engine assembly 2 which is oriented substantially perpendicular to a longitudinal axis of the leg of the engine assembly can also be termed a horizontal crankshaft arrangement.

Figure 2A:
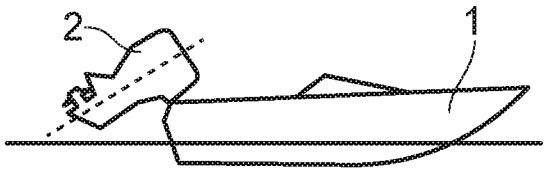
FIG. 2A shows a schematic representation of a marine engine assembly in its tilted position.

As mentioned previously, to work properly, the lower-section 23 and propeller 8 of the marine engine assembly 2 needs to extend into the water. In extremely shallow waters, however, or when launching a vessel off a trailer, the lower-section 23 of the marine engine assembly 2 could drag on the seabed or boat ramp if in the tilted-down position. Tilting the marine engine assembly 2 into its tilted-up position, such as the position shown in FIG. 2A, prevents such damage to the lower-section 23 and the propeller 8.

Figure 2B:
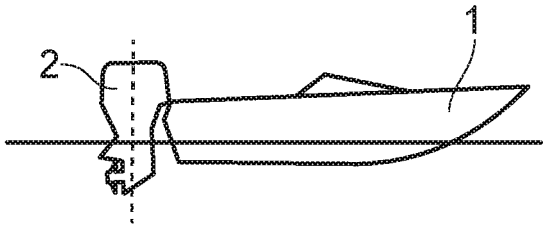
FIGS. 2B to 2D show various trimming positions of the marine engine assembly and the corresponding orientation of the marine vessel within a body of water.
Figure 2C:
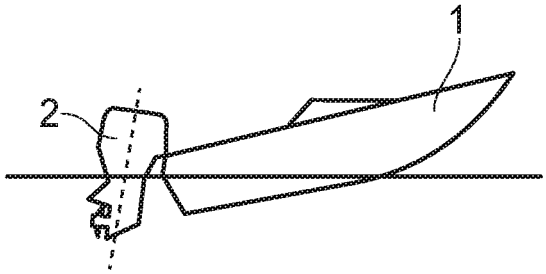
Figure 2D:
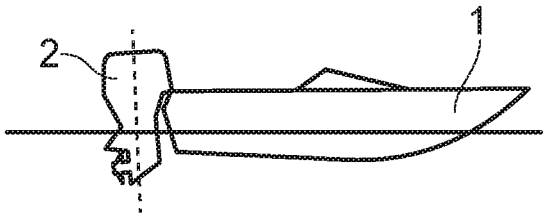

By contrast, trimming is the mechanism that moves the marine engine assembly 2 over a smaller range from a fully-down position to a few degrees upwards, as shown in the three examples of FIGS. 2B to 2D. Trimming will help to direct the thrust of the propeller 8 in a direction that will provide the best combination of fuel efficiency, acceleration and high speed operation of the corresponding marine vessel 1.

When the vessel 1 is on a plane (i.e. the weight of the vessel 1 is predominantly supported by hydrodynamic lift, rather than hydrostatic lift, a bow-up configuration results in less drag, greater stability and efficiency. This is generally the case when the keel line of the boat or marine vessel 1 is up about three to five degrees, such as shown in FIG. 2B for example.

Too much trim-out puts the bow of the vessel 1 too high in the water, such as the position shown in FIG. 2C. Performance and economy, in this configuration, are decreased because the hull of the vessel 1 is pushing the water and the result is more air drag. Excessive trimming-up can also cause the propeller to ventilate, resulting in further reduced performance. In even more severe cases, the vessel 1 may hop in the water, which could throw the operator and passengers overboard.

Trimming-in will cause the bow of the vessel 1 to be down, which will help accelerate from a standing start. Too much trim-in, shown in FIG. 2D, causes the vessel 1 to "plough" through the water, decreasing fuel economy and making it hard to increase speed. At high speeds, trimming-in may even result in instability of the vessel 1.

The marine engine assembly 2 comprises a tilt and trim mechanism 7 for performing the aforementioned tilting and trimming operations. In this embodiment, the tilt and trim mechanism 7 includes a hydraulic actuator 13 that can be operated to tilt and trim the marine engine assembly 2 via an electric control system. Alternatively, it is also feasible to provide a manual tilt and trim mechanism, in which the operator pivots the marine engine assembly 2 by hand rather than using the hydraulic actuator shown in FIG. 3.

Figure 3:
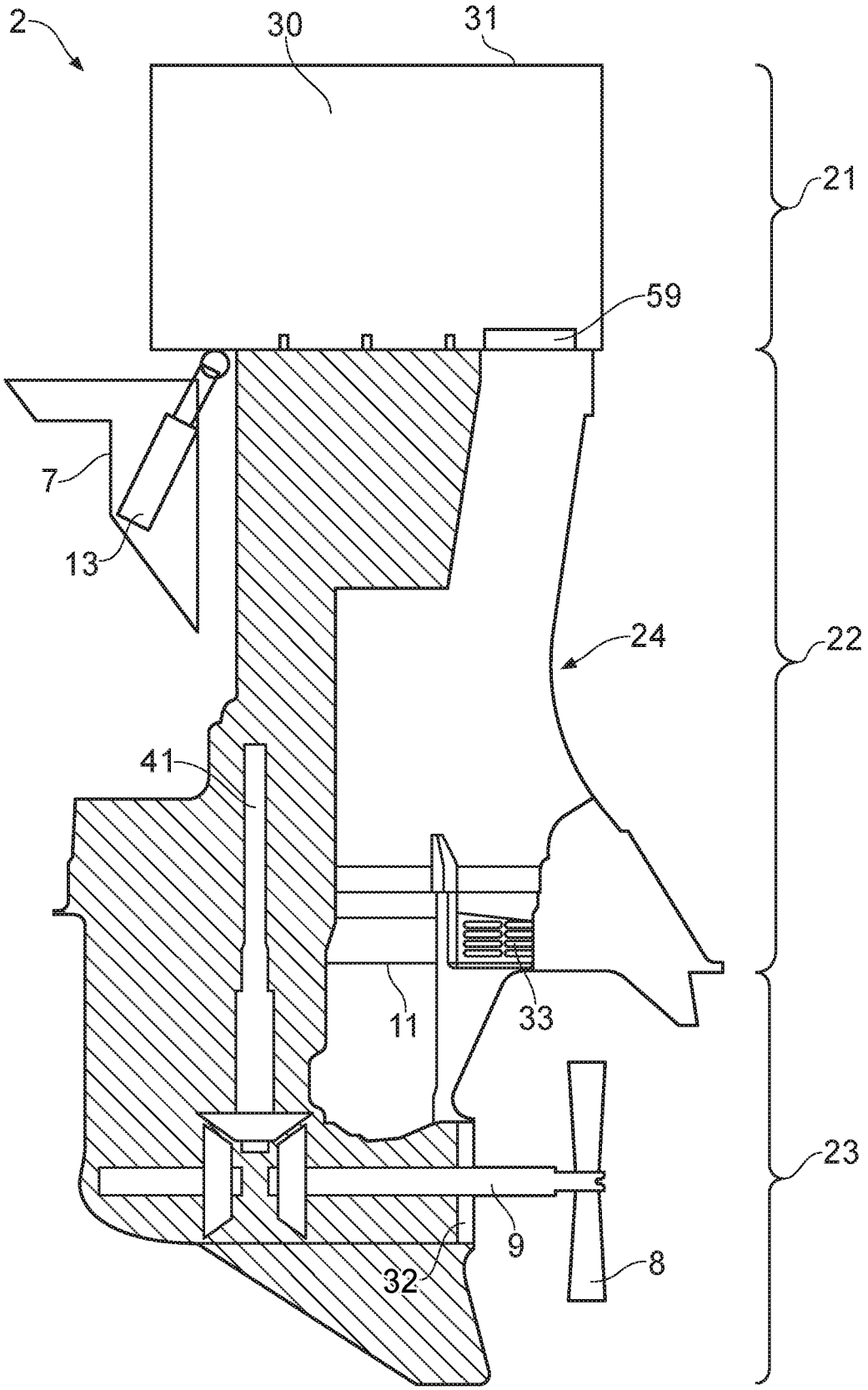
FIG. 3 shows a schematic cross-section of a marine engine assembly according to an embodiment.

Turning to FIG. 3, there is shown a schematic cross-section of a marine engine assembly 2 according to an embodiment.

As mentioned above, the marine engine assembly 2 is generally divided into three sections. An upper-section 21, also known as the powerhead, includes an internal combustion engine 30 for powering the marine vessel 1. A cowling 31 is disposed around the engine 30.

Adjacent to, and extending below, the upper-section 21 or powerhead, there is provided a mid-section 22. The lower-section 23 extends adjacent to and below the mid-section 22, and the mid-section 22 connects the upper-section 21 to the lower-section 23. The mid-section 22 houses a drive shaft 36, which extends between the combustion engine 30 and the propeller shaft 9. An anti-ventilation plate 11 prevents surface air from being sucked into the negative pressure side of the propeller 8.

The mid-section 22 and lower-section 23 form exhaust system 24, which defines an exhaust gas flow path for transporting exhaust gasses from the internal combustion engine 30 towards the lower-section 23.

In addition to accommodating the propeller 8, the exhaust system 24 defines one or more exhaust gas outlets. In the exemplary illustrated embodiment, the lower section 23 provides a first exhaust outlet 32 adjacent to the propeller drive shaft 9. When the propeller 8 is driven by the engine 30 to propel the vessel 1, the negative pressure generated by the propeller 8 draws the exhaust gases through the mid-section 22 towards the first exhaust outlet 32. This arrangement expels the majority of the exhaust gases underwater through the first exhaust outlet 32.

Additional exhaust gas outlets may also be provided, both beneath the water line and above. This enables the remaining exhaust gases not expelled through the propeller exhaust outlet 32 to be expelled from the marine engine assembly 2. Particularly, provision of the additional exhaust gas outlets enables exhaust gases to be more readily expelled from the marine engine assembly 2 when there is no negative pressure generated by the propeller 8 (i.e. when the propeller 8 is idle). In the exemplary illustrated embodiment, a second exhaust gas outlet 33 is provided within the mid-section 22. When the vessel is on a plane, as illustrated in FIG. 2B, the second exhaust gas outlet 33 is arranged to be positioned above the water line.

Figure 4:
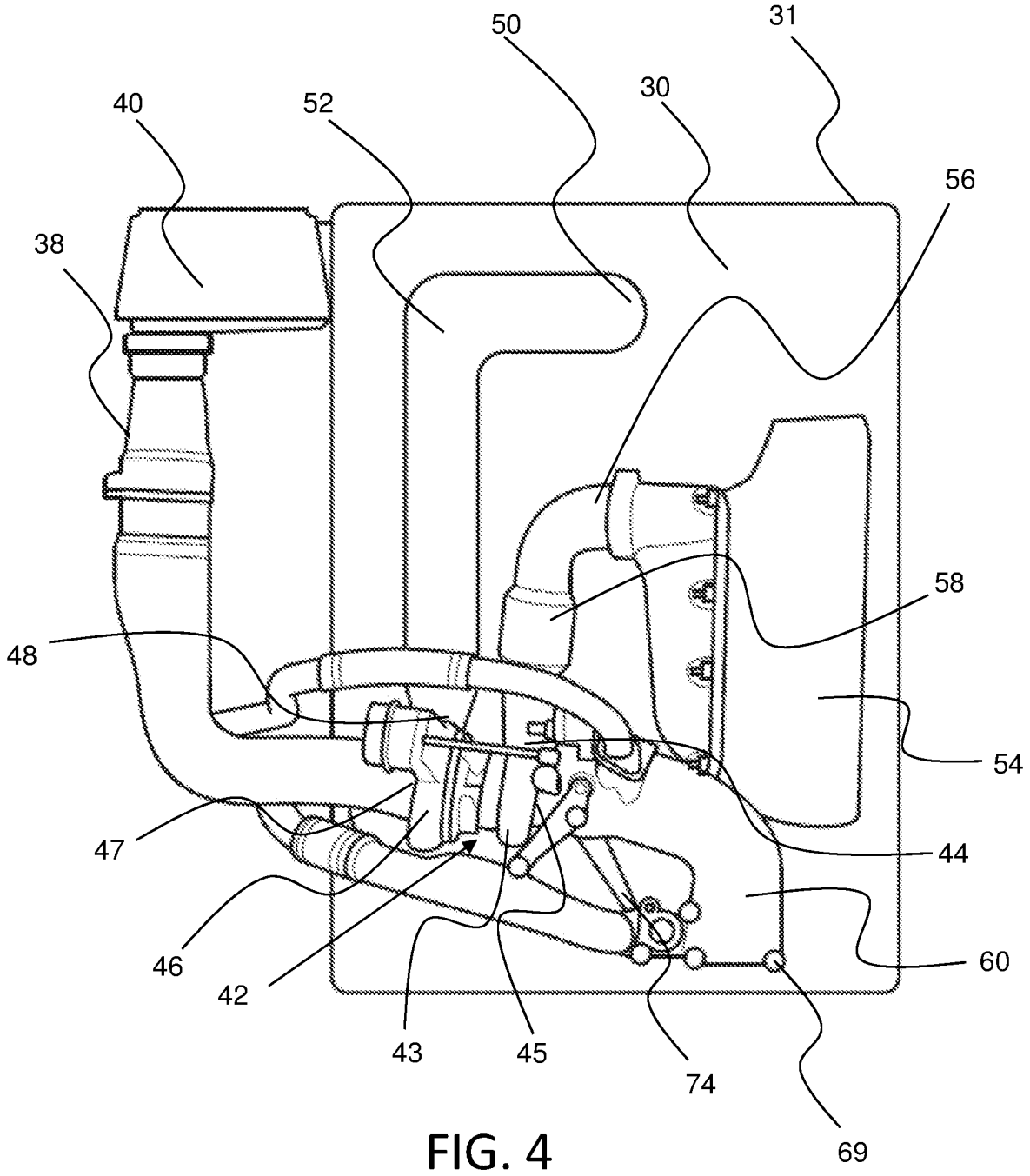
FIG. 4 shows a side view of a part of the marine engine assembly FIG. 3.

Turning now to FIG. 4, the powerhead 21 is illustrated schematically with the external cowling 31 removed.

The marine engine assembly 2 includes an air inlet which draws air into an air inlet duct 38 of the marine engine assembly 2, where the air is drawn into the inlet duct 38 via an air filter 40. The marine engine assembly 2 is provided with a turbocharger 42 for improving the power output of the internal combustion engine 30. The turbocharger is formed from a turbocharger turbine portion 43 having a turbine inlet 44 and a turbine outlet 45, and a turbocharger compressor portion 46 having a compressor inlet 47 and a compressor outlet 48.

The turbocharger compressor inlet 47 is connected to a downstream end of the inlet ducting 38 such that air can be compressed therein. The compressed air flows from compressor outlet 48 to an inlet 50 of the internal combustion engine 30 via ducting 52. In the illustrated embodiment, the ducting 52 is provided as a flexible hose configured to deliver compressed air from the compressor outlet 48 to the internal combustion engine 30. In this way, filtered air is able to flow into the turbocharger compressor 46 so as to be compressed therein prior to entering the internal combustion engine 30.

Following combustion in the engine 30, exhaust gas from the engine 11 passes to an exhaust manifold 54 that is configured to deliver exhaust gas from the internal combustion engine 30 to the turbocharger turbine inlet 44. In this way, the exhaust gas expelled from the internal combustion engine 30 is used to drive a turbine of the turbocharger 42 so as to compress the air prior to the air entering the internal combustion engine 30.

In the illustrated embodiment, the turbocharger 42 is mounted to the exhaust manifold 54 via a flexible connecting arrangement including exhaust manifold ducting 56. The ducting 56 includes a thermal expansion joint 58 such that the turbocharger 42 is mounted to the exhaust manifold 54 via a thermal expansion joint 58.

After driving the turbine portion 43 of the turbocharger 42, the exhaust gas flows to the exhaust system 24 via a turbocharger exhaust conduit 60, so as to be directed to the one or more gas outlets.

The turbocharger exhaust conduit 60 defines an exhaust flow path therethrough. The turbocharger exhaust conduit 60 has an exhaust conduit inlet 62 and an exhaust conduit outlet 64.

In marine applications, the arrangement of supporting the turbocharger 42 has traditionally been achieved via the exhaust manifold. However, this packaging/support arrangement has been found to be sub-optimal with regard to the overall packaging of the marine engine assembly.

In the present embodiment, the turbocharger exhaust conduit 60 acts as a primary support to the turbocharger 42 within the marine engine assembly 2. In order to provide sufficient support to the turbocharger 42, the turbocharger exhaust conduit 60 is mounted to a support structure within the marine engine assembly 2. That is, the turbocharger exhaust conduit 60 is configured to rigidly mount the turbocharger 42 to the support structure.

It will be appreciated that various different components of the marine engine assembly 2 may provide the function of the support structure, such as a part of the leg section of the marine engine assembly 2 (e.g. a part of the mid-section 22), one or more of the components of the internal combustion engine 30 or an adaptor member provided between the internal combustion engine 30 and the leg section.

The exhaust system 24 defines an exhaust system inlet 59 (illustrated in FIG. 3), and the outlet 64 (illustrated in FIG. 6) of the turbocharger exhaust conduit 60 is coupled to the exhaust system inlet 59. In this way, the connection rigidly mounts the turbocharger exhaust conduit 60 to the exhaust system 24. Although not illustrated, the turbocharger exhaust conduit 60 can be rigidly mounted to the exhaust system inlet 59 via an adaptor member provided between the internal combustion engine 30 and the leg section. In this way, the support structure can be provided as part of the exhaust system 24 (i.e. via the adaptor member).

The turbocharger exhaust conduit 60 preferably a greater rigidity than any other connection of the turbocharger 42 to the marine engine assembly 2. That is, the turbocharger exhaust conduit has a higher rigidity than one or more of, and preferably all of, the inlet ducting 38, than the engine inlet ducting 52 or the exhaust manifold ducting 56. The turbocharger exhaust conduit preferably has a higher rigidity than the exhaust manifold ducting 56.

This arrangement allows substantially all of the mechanical forces from the turbocharger 42 to be reacted through the turbocharger exhaust conduit 60. Put another way, more of the forces from the turbocharger 42 are reacted through the turbocharger exhaust conduit 60 than one or more other connection(s) of the turbocharger (e.g. more than the inlet ducting 38, the engine inlet ducting 52 and/or the exhaust manifold ducting 56).

As is shown, the arrangement of the turbocharger exhaust conduit 60 is such that the exhaust conduit outlet 64 is positioned to be substantially level with or below a lower extent of the internal combustion engine 30, in use.

Figure 5:
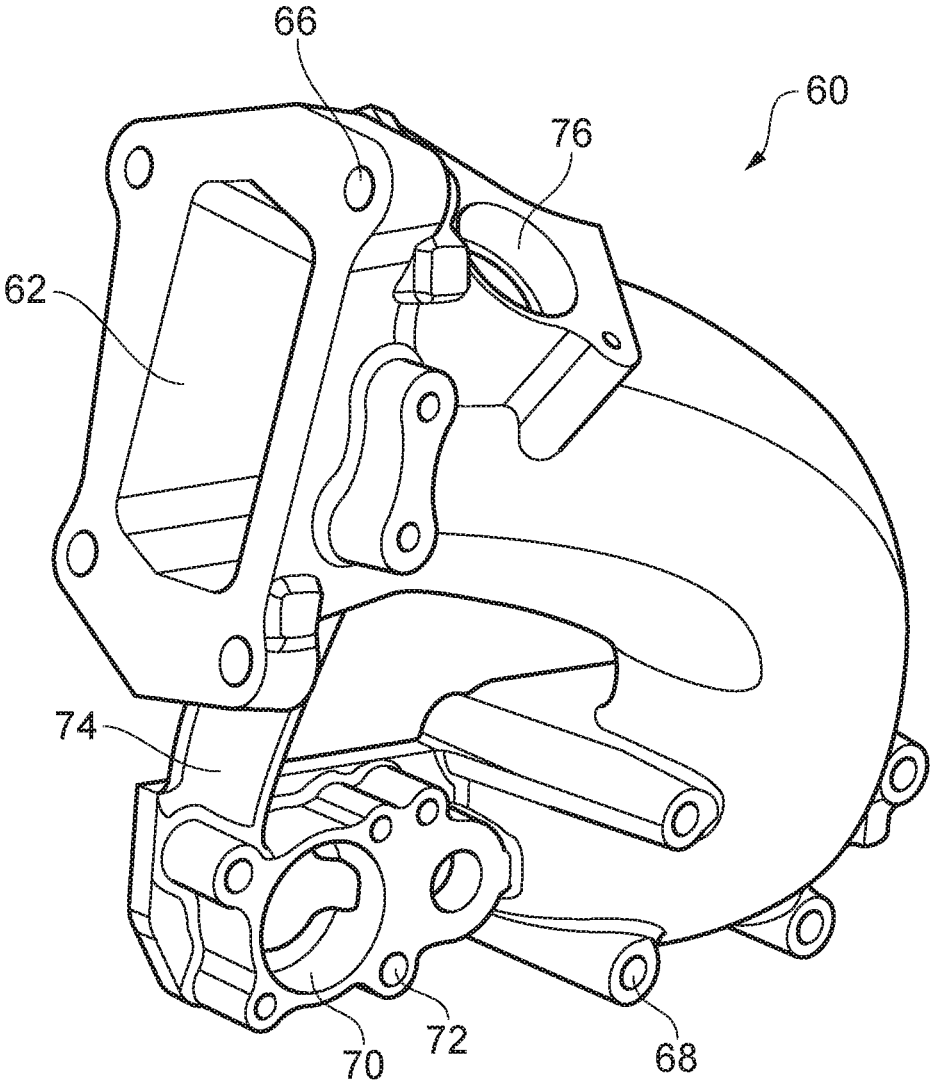
FIG. 5 shows a perspective isometric view of the turbocharger exhaust conduit of FIG. 4.
Figure 6:
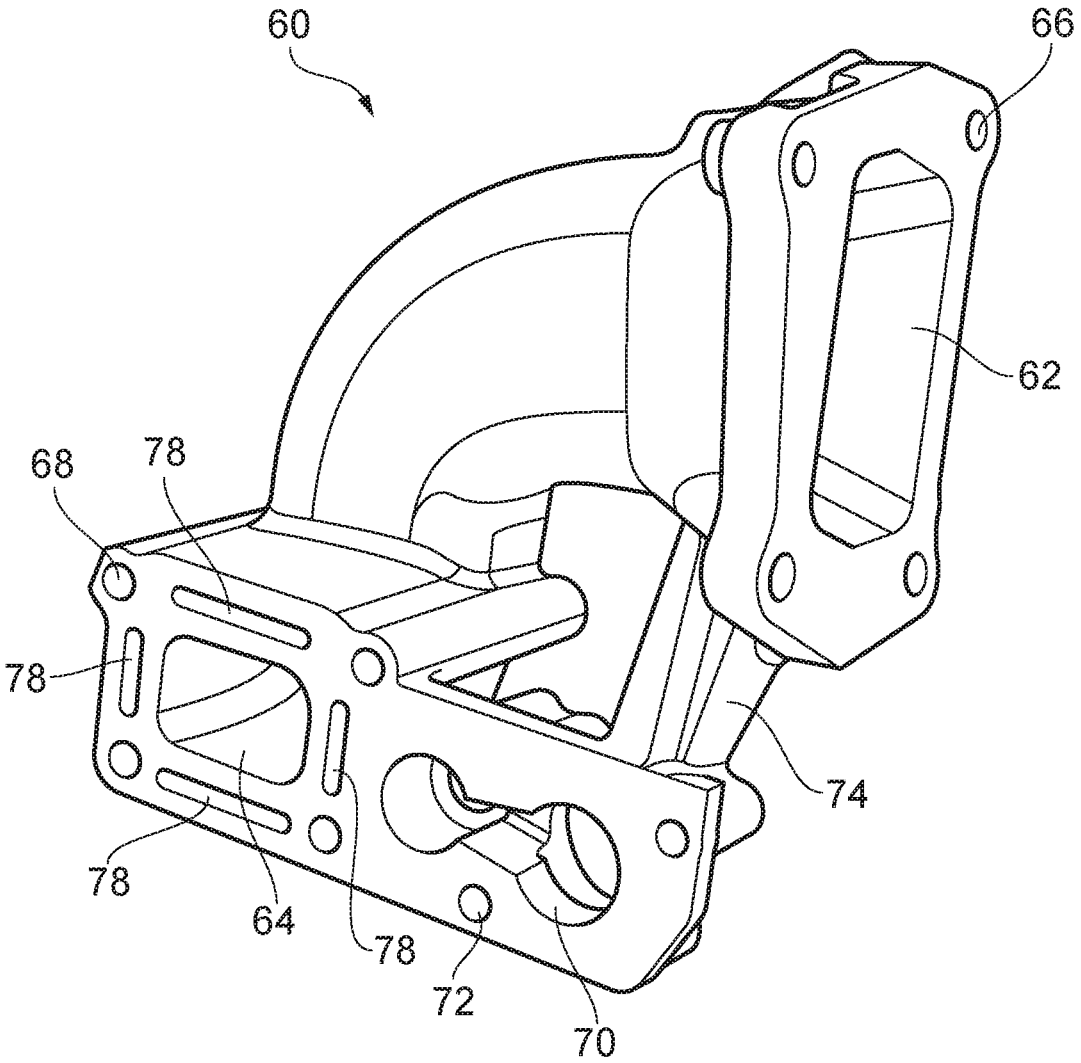
FIG. 6 shows an alternate perspective isometric view of the turbocharger exhaust conduit of FIG. 5.

Finally, turning to FIGS. 5 and 6, the turbocharger exhaust conduit 60 is illustrated in more detail.

The turbocharger exhaust conduit 60 is provided with a first mounting arrangement 66 for mounting the turbocharger exhaust conduit 60 to the turbine outlet 45 of the turbocharger 42. In the illustrated embodiment, the first mounting arrangement 66 includes four bores for receiving fasteners therethrough.

The turbocharger exhaust conduit 60 is provided with a second mounting arrangement 68 for mounting the turbocharger exhaust conduit 60 to the exhaust system inlet 59 of the exhaust system 24. More specifically, the mounting arrangement 68 mounts the exhaust conduit outlet 64 to the adapter member provided between the conduit 60 and the exhaust system 24. In the illustrated embodiment, the second mounting arrangement 68 includes four bores for receiving fasteners 69 therethrough.

Adjacent to the exhaust conduit outlet 64, the turbocharger exhaust conduit 60 includes a bore 70 therethrough and a third mounting arrangement 72 for securing an additional coolant duct to the bore 70. This additional cooling arrangement can be provided so as to be able to cool additional components of the marine engine assembly 2.

In order to provide sufficient support to the turbocharger 42, the turbocharger exhaust conduit 60 is formed from a rigid material, such as a metallic material. In the present embodiment, the turbocharger exhaust conduit 60 is formed from aluminium, but any suitable rigid material may be used.

The turbocharger exhaust conduit 60 is curved such that it is substantially L-shaped in side view. In order to increase the rigidity of the turbocharger exhaust conduit 60, a support strut 74 may be provided. In the illustrated embodiment, the support strut 74 extends from proximate the conduit inlet 62 to proximate the conduit outlet 64. It will be appreciated that, in alternative arrangements, the strut may be omitted.

The outlets of the turbochargers are significant high temperature components. That is, the turbocharger exhaust conduit 60 is a significant high temperature component. Due to the limited space in the marine engine assembly 2, the turbocharger exhaust conduit 60 runs close to the cowling, which can result in damage to the cowling.

The turbocharger exhaust conduit 60 is further provided with a cooling arrangement for cooling the turbocharger exhaust conduit 60. The cooling arrangement is provided in the form of a coolant flow path through the turbocharger exhaust conduit 60 to allow a coolant, e.g. water, to flow therealong.

The coolant flow path defines an inlet 76 proximate to the conduit inlet 62 and an outlet 78 proximate to the conduit outlet 64. More specifically, the outlet 78 of the coolant flow path is split into a plurality of, such as the illustrated four, separate outlets that can be positioned and arranged around the exhaust conduit outlet 64.

The exhaust outlet conduit 60 is configured such that the coolant flow path extends around the exhaust flow path so as to improve cooling efficiency. Put another way, the coolant flow path is arranged such that it substantially surrounds the exhaust flow path (i.e. to provide a coolant jacket).

In the embodiment, the coolant jacket is provided by forming a cavity between the inner and outer walls of the turbocharger exhaust conduit 60. Put another way, the coolant jacket is formed by providing a cavity between the outer wall of the turbocharger exhaust conduit and the outer wall of the exhaust flow path.

Whilst the exhaust outlet conduit 60 has been described as having the conduit inlet 62 proximate the coolant flow path inlet 76, it will be appreciated that, in alternative arrangements, the coolant flow path inlet 76 and coolant outlet 78 may be switched such that the cooling arrangement defines a contraflow flow path.

Although the invention has been described above with reference to one or more preferred embodiments, it will be appreciated that various changes or modifications may be made without departing from the scope of the invention as defined in the appended claims.

The invention claimed is:

1. A marine engine assembly for propelling a marine vessel, the marine engine assembly comprising:

an internal combustion engine configured to drive a propulsion arrangement;

a cowling disposed around the internal combustion engine;

a turbocharger comprising a turbine portion having a turbine outlet;

a support structure for supporting the turbocharger;

a turbocharger exhaust conduit coupled to the turbine outlet and having a turbocharger exhaust conduit outlet positioned substantially level with or below a lower extent of the internal combustion engine in use; and an exhaust system housed in a leg section of the marine engine assembly and positioned below the internal combustion engine, the exhaust system having an exhaust system inlet coupled to the turbocharger exhaust conduit outlet, wherein the turbocharger exhaust conduit is formed from a rigid material and is rigidly mounted to the exhaust system inlet such that the turbocharger exhaust conduit acts as a primary support to the turbocharger within the marine engine assembly and the exhaust system inlet provides the support structure for supporting the turbocharger, and wherein the turbocharger and the turbocharger exhaust conduit are both disposed in a bottom half of the cowling.

2. The assembly according to claim 1, wherein the turbocharger exhaust conduit has a greater rigidity than any other connection of the turbocharger to the marine engine assembly.

3. The assembly according to claim 1, wherein more mechanical force from the turbocharger is reacted through the turbocharger exhaust conduit than any other connection of the turbocharger to the engine assembly.

4. The assembly according to claim 1, wherein substantially all mechanical force from the turbocharger is reacted through the turbocharger exhaust conduit.

5. The assembly according to claim 1, wherein the turbocharger exhaust conduit is formed from a metallic material.

6. The assembly according to claim 1, further comprising an exhaust manifold configured to deliver exhaust gas from the internal combustion engine to the turbocharger.

7. The assembly according to claim 6, wherein the turbocharger is connected to the exhaust manifold via a flexible connecting arrangement.

8. The assembly according to claim 7, wherein the turbocharger is mounted to the exhaust manifold via one or more thermal expansion joints.

9. The assembly according to claim 1, wherein the turbocharger is further connected to the internal combustion engine via a flexible hose configured to deliver compressed air from the turbocharger to the internal combustion engine.

10. The assembly according to claim 1, wherein the turbocharger exhaust conduit comprises a coolant flow path therethrough for cooling the turbocharger exhaust conduit.

11. The assembly according to claim 10, wherein the coolant flow path is arranged to flow around an exhaust flow path.

12. The assembly according to claim 11, wherein the coolant flow path is arranged to substantially surround the exhaust flow path.

13. The assembly according to claim 1, wherein the propulsion arrangement is arranged to be positioned below the internal combustion engine, in use.

14. The assembly according to claim 13, further comprising a crankshaft coupled to the internal combustion engine and configured to drive the propulsion arrangement.

15. The assembly according to claim 14, wherein the crankshaft is intended to be substantially vertical, in use.

16. The assembly according to claim 1, wherein the internal combustion engine is a diesel engine.

17. The assembly according to claim 1, wherein the turbocharger exhaust conduit comprises a support strut for increasing the rigidity of the exhaust conduit.

18. A marine vessel, wherein the marine vessel includes the marine engine assembly according to claim 1.

* * * * *